US007868824B2

(12) United States Patent
Sumi

(10) Patent No.: US 7,868,824 B2
(45) Date of Patent: Jan. 11, 2011

(54) BEAMFORMING APPARATUS AND METHOD

(76) Inventor: Chikayoshi Sumi, Yourcourt Tokorozawa Kusunoki-dai 303, 3-18-6, Kusunoki-dai, Tokorozawa-shi, Saitama 359-0037 (JP)

( * ) Notice: Subject to any disclaimer, the term of this patent is extended or adjusted under 35 U.S.C. 154(b) by 285 days.

(21) Appl. No.: 11/827,359

(22) Filed: Jul. 11, 2007

(65) Prior Publication Data

US 2008/0048911 A1 Feb. 28, 2008

(30) Foreign Application Priority Data

Jul. 14, 2006 (JP) ..... 2006-193506

(51) Int. Cl.
*H01Q 3/00* (2006.01)
*H01Q 3/22* (2006.01)

(52) U.S. Cl. ..... 342/375; 342/373

(58) Field of Classification Search ..... 342/154, 342/157, 360, 368, 372, 373, 375
See application file for complete search history.

(56) References Cited

U.S. PATENT DOCUMENTS 6,401,539 B1 * 6/2002 Langdon et al. ..... 73/609
6,527,720 B1 * 3/2003 Ustuner et al. ..... 600/443
2003/0069504 A1 * 4/2003 Wilkening et al. ..... 600/443

FOREIGN PATENT DOCUMENTS

JP 2001-104307 A 4/2001

OTHER PUBLICATIONS

K. Ranganathan, W. F. Walker, "A Novel Beamformer Design Method for Medical Ultrasound. Part I: Theory", IEEE Trans. on Ultrasonics, Ferroelectrics, and Frequency Control, vol. 50, No. 1, pp. 15-24, Jan. 2003.
K. Ranganathan, W. F. Walker, "A Novel Beamformer Design Method for Medical Ultrasound. Part II: Simulation Results", IEEE Trans. on Ultrasonics, Ferroelectrics, and Frequency Control, vol. 50, No. 1, pp. 25-39, Jan. 2003.
D. A. Guenther, W. F. Walker, "Optimal Apodization Design for Medical Ultrasound Using Constrained Least Squares Part I: Theory", IEEE Trans. on Ultrasonics, Ferroelectrics, and Frequency Control, vol. 54, No. 2, pp. 332-342, Feb. 2007.

(Continued)

*Primary Examiner*—Dao L Phan
(74) *Attorney, Agent, or Firm*—Frishauf, Holtz, Goodman & Chick, P.C.

(57) ABSTRACT

A beamforming apparatus obtains the beamforming parameters that realize arbitrary desirable PSF by using optimization theories. The apparatus uses at least one of the beamforming parameters such as the intensities, frequencies, bandwidths and shapes of the signals transmitted by the transmitting unit, the filtering of noises, amplifications (gains) and shapes of the signals received by the receiving unit, delays of the directions of propagation and array used by the delay units, apodization functions of the directions of propagation and array used by the apodization units, the number of the additions of the signals by the addition unit, array element parameters such as element size or shape and how to implement the elements in transducers (e.g., connections by leads between the elements and with the surroundings), which are determined by the specified optimization process to realize the desirable PSF.

4 Claims, 5 Drawing Sheets

OTHER PUBLICATIONS

D. A. Guenther, W. F. Walker, "Optimal Apodization Design for Medical Ultrasound Using Constrained Least Squares Part II: Simulation results", IEEE Trans. on Ultrasonics, Ferroelectrics, and Frequency Control, vol. 54, No. 2, pp. 343-358, Feb. 2007.

C. Sumi, "Determination of Lateral Modulation Apodization Functions Using a Regularized, Weighted Least Squares Estimation", International Journal of Biomedical Imaging, 635294, Mar. 2010.

* cited by examiner

BEAMFORMING APPARATUS AND METHOD

BACKGROUND OF THE INVENTION

1. Field of the Invention

The present invention relates to a beamforming apparatus and a beamforming method to be used for performing beamforming of electromagnetic wave, light, sound, ultrasound in radars, sonars, ultrasonic diagnosis apparatuses and so on.

2. Description of a Related Art

Measurements regarding various states (physical properties, the distributions, etc.) of various objects and living things, distributions of objects, and environments are performed by using radars, sonars and ultrasonic diagnosis apparatuses. In order to realize proper measurements, beamforming is usually performed (in a reflection or transmission mode, etc.). Beamforming is also performed for measurements of various target motions (velocity, displacement, strain, acceleration, strain rate, etc.). In addition, beamforming is also performed on various energies used for treatments and repairing of various targets.

FIG. 4 shows the components in a typical beamforming apparatus. This beamforming apparatus includes a transmitting unit 101, a receiving unit 102, apodizing units 104 and 104', and an addition unit 105 of signals. The units 101 and 102 are respectively equipped with delay units 103 and 103'. The delay units can also be equipped outside the units 101 and 102. The orders of the units in the beamforming apparatus can also be inverted. Further, more than two units can also be realized as one unit. The intensities, frequencies, bandwidths, and shapes of transmission signals are determined by the unit 101, and the reductions of noises and amplifications of reception signals are performed by the unit 102. The shape of the signals can also be changed by filtering, etc. Moreover, the intensities and shapes of the respective signals can also be changed by the apodization units 104 and 104'.

The number of the channels in the units determines available numbers of signals and array elements (2D or 1D) to be used independently. The actual number of additions of signals can also be determined in the unit 105. Various beamforming such as focusing (FIG. 5A) and steering (FIG. 5B) are performed by adding reception signals after controlling the delays of the transmission and reception signals in the units 103 and 103'.

As a related art, Japanese patent application publication JP-P2001-104307A (FIG. 1) discloses, for reception beamformers, the realization of the functions for controlling of the delays and amplitudes of signals in integrated circuit chips. All calculations as functions of time related to the delays and amplitudes (gains) are performed outside the chips. The data of delays and amplitudes are calculated in advance by a conventional computer and the data are simply used in the chips to set the functions of delays and amplifications. That is, the chips are equipped with the functions of the delays and amplifications.

However, in order to obtain the best measurement accuracy of target motion, spatial resolutions and contrasts of treatment and image, after designing the desirable point spread function (PSF), the beamforming that realizes the designed PSF should be performed at transmitting and/or receiving processes. In pasts, there exists no apparatus that realizes such beamforming. Usually, theoretical analyses or numerical calculations of electromagnetic fields and sound fields are performed to design the beamforming. However, after all, by changing the beamforming parameters such as the intensities, frequencies, bandwidths and shapes of the signals transmitted by the transmitting unit, the filtering of noises, amplifications (gains) and shapes of the signals received by the receiving unit, the number of the additions of the signals by the addition unit, apodization functions of the directions of propagation and array used by the apodization unit, delays of the directions of propagation and array used by the delay unit on the basis of the experiences, the beamforming apparatus is realized. Thus, the best beamforming cannot always be obtained. In addition, a spatially and temporally uniform or arbitrary PSF should be realized occasionally.

SUMMARY OF THE INVENTION

The present invention has been achieved in view of the above-mentioned problems. The purpose of the present invention is to provide a beamforming method that realizes the best approximation of the desirable point spread function (PSF) designed or chosen for the best measurement (purpose), i.e., to provide the viewpoint and a method of calculating the parameters, and to provide a beamforming apparatus that uses the calculated parameters.

The beamforming apparatus according to a first aspect of the present invention comprises a transmitting unit, a receiving unit, apodization units and an addition unit, and uses at least one of the beamforming parameters such as the intensities, frequencies, bandwidths and shapes of the signals transmitted by the transmitting unit, the filtering of noises, amplifications (gains) and shapes of the signals received by the receiving unit, the number of the additions of the signals by the addition unit, apodization functions to be used by the apodization units according to the directions of propagation and an element array, delays in the delay unit according to the directions of propagation and an element array, which are determined by the specified optimization process to realize the desirable PSF. Thus, the apparatus further comprises a unit for inputting the PSF and a unit for calculating the parameters. The apparatus may further comprise a unit for outputting the calculated parameters. The apparatus may further comprise a display unit that shows the designed PSF and the actually realized or measured (by a hydrophone, etc.) PSF. Occasionally, the mechanical shift in lateral and/or elevational directions of the elements (array transducers) is also performed, if necessarily. The parameters for the transmission and reception beamforming can be determined individually. Thus, under different setting of parameters (e.g., axicon and spherical focusings respective for the transmission and reception beamforming), the parameters can also be determined. Only one of parameters for the transmission and reception beamforming can also be determined. Otherwise, either result can also be used for both the transmission and reception beamforming. The respective parameters may be optimized under related some constraints, e.g., an effective aperture size, an available energy or intensity and so on.

The beamforming apparatus according to a second aspect of the present invention also comprises a transmitting unit, a receiving unit, apodization units and an addition unit, and uses at least one of the beamforming parameters such as the intensities, frequencies, bandwidths and shapes of the signals transmitted by the transmitting unit, the filtering of noises, amplifications (gains) and shapes of the signals received by the receiving unit, the number of the additions of the signals by the, addition unit, apodization functions to be used by the apodization units according to the directions of propagation and an element array, delays in the delay unit according to the directions of propagation and an element array, which are calculated by another apparatus. Thus, the beamforming apparatus further comprises a unit for inputting the calculated parameters. The beamforming apparatus may further comprise a display unit that shows the designed PSF and the actually realized or measured (by a hydrophone etc.) PSF. Occasionally, the mechanical shift in lateral and/or elevational directions of the elements (array transducers) is also performed, if necessarily. The parameters for the transmission and reception beamforming can be determined individually. Thus, under different setting of parameters (e.g., axicon and spherical focusings respective for the transmission and reception beamforming), the parameters can also be determined. Only one of parameters for the transmission and reception beamforming can also be determined. Otherwise, either result can also be used for both the transmission and reception beamforming. The respective parameters may be optimized under related some constraints, e.g., an effective aperture size, an available energy or intensity and so on.

The present invention described above enables to obtain the proper beamforming parameters to realize a desirable PSF and further enables to realize the proper beamforming by using the parameters.

DESCRIPTION OF THE PREFERRED EMBODIMENTS

Figure 1:
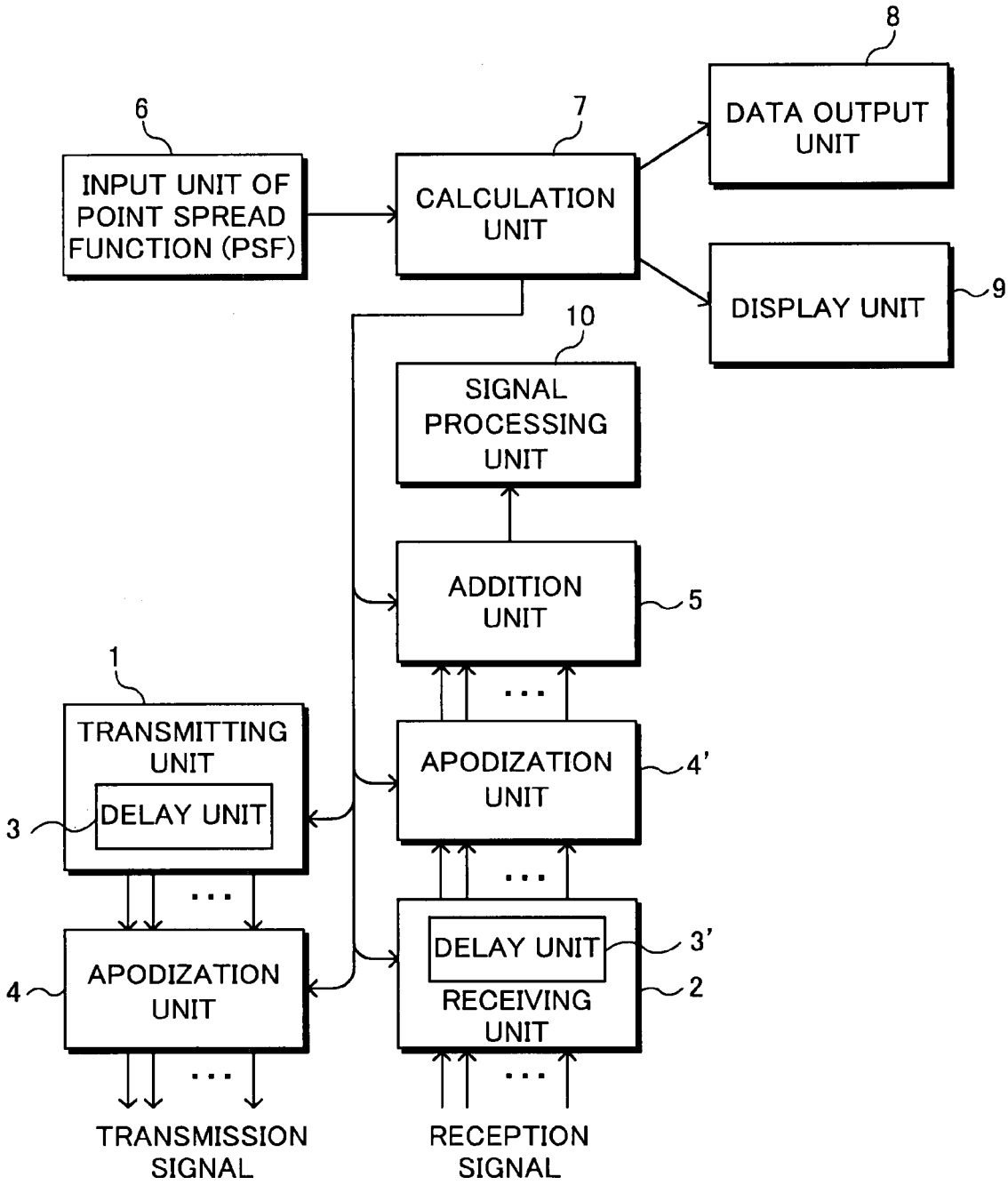
FIG. 1 shows a schematic representation of components of the beamforming apparatus according to a first embodiment of the present invention.

Hereinafter, preferred embodiments of the present invention will be described in detail by referring to the drawings. The same reference numerals are assigned to the same component elements and the description thereof will be omitted.

FIG. 1 shows a schematic representation of components of the beamforming apparatus according to a first embodiment of the present invention. The beamforming apparatus includes a transmitting unit 1, a receiving unit 2, apodizing units 4 and 4', an addition unit 5, and a signal processing unit 10. The units 1 and 2 are respectively equipped with delay units 3 and 3'. For instance, this beamforming apparatus can be applied to an ultrasonic diagnosis apparatus.

The transmitting unit 1 is equipped with one or plural signal generators such as pulsers. The signals generated by the signal generators are delayed for a transmission beamforming by the plural channels of the delay unit 3. After the amplitudes and/or shapes (waveforms) of the generated plural transmission signals are adjusted by the apodization unit 4, for instance, the signals are provided to ultrasonic transducers (outside of the beamforming apparatus is not shown in FIG. 1). The ultrasounds transmitted from the respective elements of an array (or ultrasonic transducers) are synthesized in a space. Thus, a transmission beamforming is performed.

The respective elements of the array (or ultrasonic transducers) receiving ultrasounds (ultrasonic echoes) generate reception signals. The reception signals are provided to the receiving unit 2. After the reception signals are amplified by preamps and filtered to reduce noises, the reception signals are delayed for a reception beamforming by the plural channels of the delay unit 3'. After the amplitudes and/or shapes (waveforms) of the plural reception signals are adjusted by the apodization unit 4', the signals are added to one another by the addition unit 5 to realize the reception beamforming. The signal processing unit 10 for signal processing yields measurement results such as image data by performing A/D conversions on the signals provided by the addition unit 5 and by using a digital scan converter.

The apparatus uses at least one of the beamforming parameters such as the intensities, frequencies, bandwidths and shapes of the signals transmitted by the transmitting unit 1, the filtering of noises, amplifications (gains) and shapes of the signals received by the receiving unit 2, a number of the additions of the signals by the addition unit 5, apodization functions to be used by the apodization unit 4 and 4' according to a direction of propagation and a direction of a transducer array, delays in the delay unit 3 and 3' according to the direction of propagation and the direction of the transducer array, which are determined by the specified optimization process to realize the desirable PSF.

Accordingly, the apparatus also includes an input unit 6 for inputting the PSF and/or the parameters (or choosing the candidates that are set in advance), and a calculation unit 7 for calculating the beamforming parameters. The calculation unit 7 provides the calculated parameters to be used in the transmitting unit 1, the receiving unit 2, the apodization units 4 and 4', and/or the addition unit 5.

The apparatus can also include a data output unit 8 for outputting the data such as the calculated parameters. For example, the data output unit 8 can use a memory, a hard disk, a flexible disk, or a CD-ROM. The apparatus can also include the display unit 9 for showing the actually realized or measured (by a hydrophone etc.) PSF. The display unit 9, which is realized by a CRT, a liquid crystal, or a LED, can show the calculated PSF together with the measured PSF. The calculation unit 7 for calculation process can be realized by employing a digital circuit and/or a CPU and a program. In the calculation unit 7, expression (1) specifically described later is minimized to obtain the parameters.

In the present invention, two principles of the calculation methods of beamforming parameters are will be explained. Both principles determine the parameters by minimizing the expression (1). Dependent of the parameter to be calculated, the minimization is realized by linear or nonlinear calculation.

Figure 2:
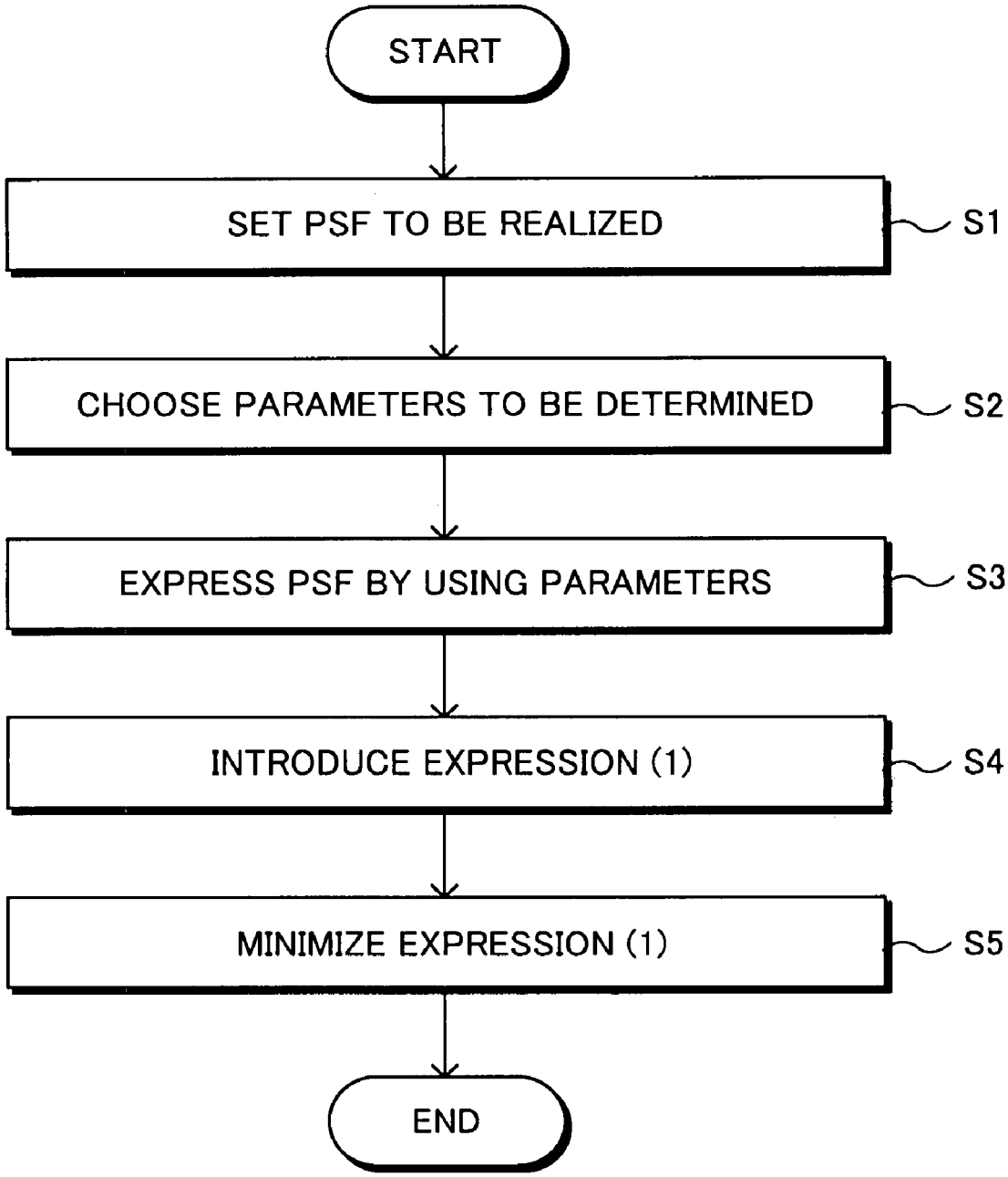
FIG. 2 shows a flowchart of calculation of the parameters used in the beamforming method according to a first embodiment of the present invention.

The following is explanation of the calculation method of the beamforming parameters to be used in the beamforming method according to the first embodiment of the present invention with referring to FIG. 2 (flowchart).

At step S1, the PSF p(x,y,z,t) to be realized is set (or predetermined). The "x", "y" and "z" are spatial coordinate axes and "t" is time. The PSF to be realized can be temporally invariant.

For instance, as the best PSF with respect to some measurement target, the expression may be given as follows:

$$p(x,y,z)=A\exp(-x^2/2\sigma_x^2)\cos\omega_x x\times\exp(-y^2/2\sigma_y^2)\cos\omega_y y\times\exp(-z^2/2\sigma_z^2)\cos\omega_z z$$

In such a case of expression given, some parameters, e.g., some of $\sigma_x$, $\sigma_y$, $\sigma_z$, $\omega_x$, $\omega_y$, $\omega_z$ may be realized not by the present invention, that is, may be predetermined. Alternately, the spatial and/or temporal data may be given as a distribution, i.e., such an expression may not be given.

At step S2, the parameters (a,b,c, . . . ) to be determined are chosen. As described above, the beamforming parameter(s)

includes at least one of the intensities, frequencies, bandwidths and shapes of the transmission signals to be supplied to the ultrasonic transducers, the filtering of noises, amplifications (gains) and shapes of the reception signals received by the receiving unit 2, the number of the additions of the signals by the addition unit 5, apodization functions to be used by the apodization units 4 and 4' according to the directions of propagation and the array, and delays to be used by the delay units 3 and 3' according to the directions of propagation and the array.

At step S3, the PSF p(x,y,z,t) is expressed by a numerical calculation and/or an approximation of the field by using the estimates of the parameters. The program can be used widely, one for marketing or freeware can also be used. The expressed PSF is denoted by p'(x,y,z,t; a,b,c, . . . ). On the basis of the theory, the PSF can also be expressed analytically or numerically by using the parameters. In such a case, some approximations may be performed such as a homogeneity or infinity of the target medium. Otherwise, the PSF may be obtained by the actual measurement under the use of the parameters. In such a case, the standard (liquid, air, or solid) or the target itself can be used. The PSF can be obtained by directly measuring with the use of a hydrophone, or by using the known calculation method from the measured field.

At step S4, the error between the expressed (or calculated) PSF p'(x,y,z,t; a,b,c . . . ) and the chosen (or predetermined) PSF p(x,y,z,t) is expressed as follows.

$$\text{error}(a,b,c,\ldots)=\Sigma_R|p(x,y,z,t)-p'(x,y,z,t;\ a,b,c\ldots)|^2 \quad (1)$$

where R is a predetermined region such that R covers a part of the chosen PSF at least. The important regions in R can also be controlled by multiplying a weight to the norm in expression (1) at each point (i.e., weight minimization).

At step S5, the expression (1) is minimized. That is, the calculation unit 7 calculates PSF p'(x,y,z,t; a,b,c . . . ) so as to obtain at least one beamforming parameter by minimizing an error between the calculated PSF p'(x,y,z,t; a,b,c . . . ) and a predetermined PSF p(x,y,z,t).

As described above, the function "error(a,b,c, . . . )" is minimized linearly or nonlinearly. In the linear case, the algebraic equations are solved by using a proper solver (e.g., least squares solution, minimum norm solution, weighted minimization, conjugate gradient method), whereas in the nonlinear case, an iterative method such as a Newton Raphson method is used to update the estimates of the parameters and the field or PSF p'(x,y,z,t; a,b,c . . . ). In such an iterative case, instead of the calculation of the field or PSF p'(x,y,z,t; a,b,c . . . ), measurements of the field or PSF p'(x,y,z,t; a,b, c . . . ) can be used.

Occasionally, to stabilize the minimization of the expression (1), the so-called regularization is used. That is, to realize the spatial and/or temporal continuity or differentiability, error(a,b,c, . . . ) of plural positions or times are simultaneously minimized. Occasionally, the common parameters for plural positions or times may also be obtained (e.g., for multiple-depth transmitting focuses). In a linear case, the singular value decomposition may also be used. When using an iterative method in a linear or nonlinear case to obtain the apodization parameters, as the initial estimate, the results obtained by Fraunhofer approximation can be used.

Occasionally, the beamforming parameters can also be obtained by using the so-called linear programming method and dynamic programming method. Otherwise, various optimization methods can also be used.

The above-described principle of the calculation method of the beamforming parameters to be used in the beamforming method according to the first embodiment of the present invention can be used for improving all the spatial resolution and contrast of the measurement target (e.g., image), the spatial resolution and effectiveness of the treatment, measurement accuracy of target motion (including the spatial resolution) when using element arrays of radars, sonars and ultrasonic diagnosis apparatuses, etc. Because the beamforming parameters depend on the array parameters such as the shapes or sizes of elements and how to implement the elements in transducers (e.g., connections by leads between the elements and couplings with the surroundings), such array parameters and the methods are determined together with the beamforming parameters by dealing with the parameters simultaneously or independently in a similar way by using the designed or obtained beamforming parameters. The respective parameters may be optimized under related some constraints, e.g., an effective aperture size, an available energy or intensity and so on.

Figure 3:
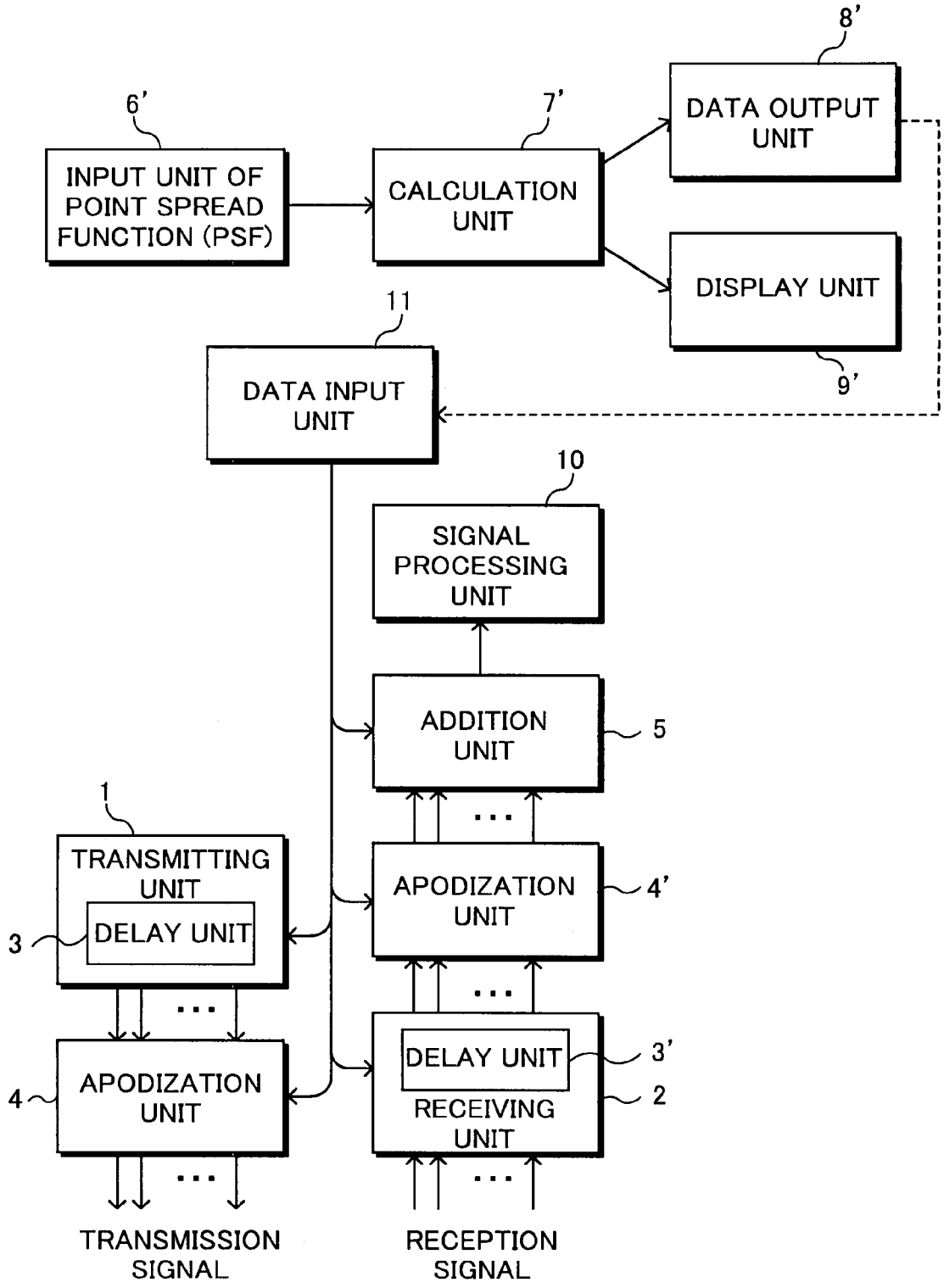
FIG. 3 shows a schematic representation of components of the beamforming apparatus according to a second embodiment of the present invention.
Figure 4:
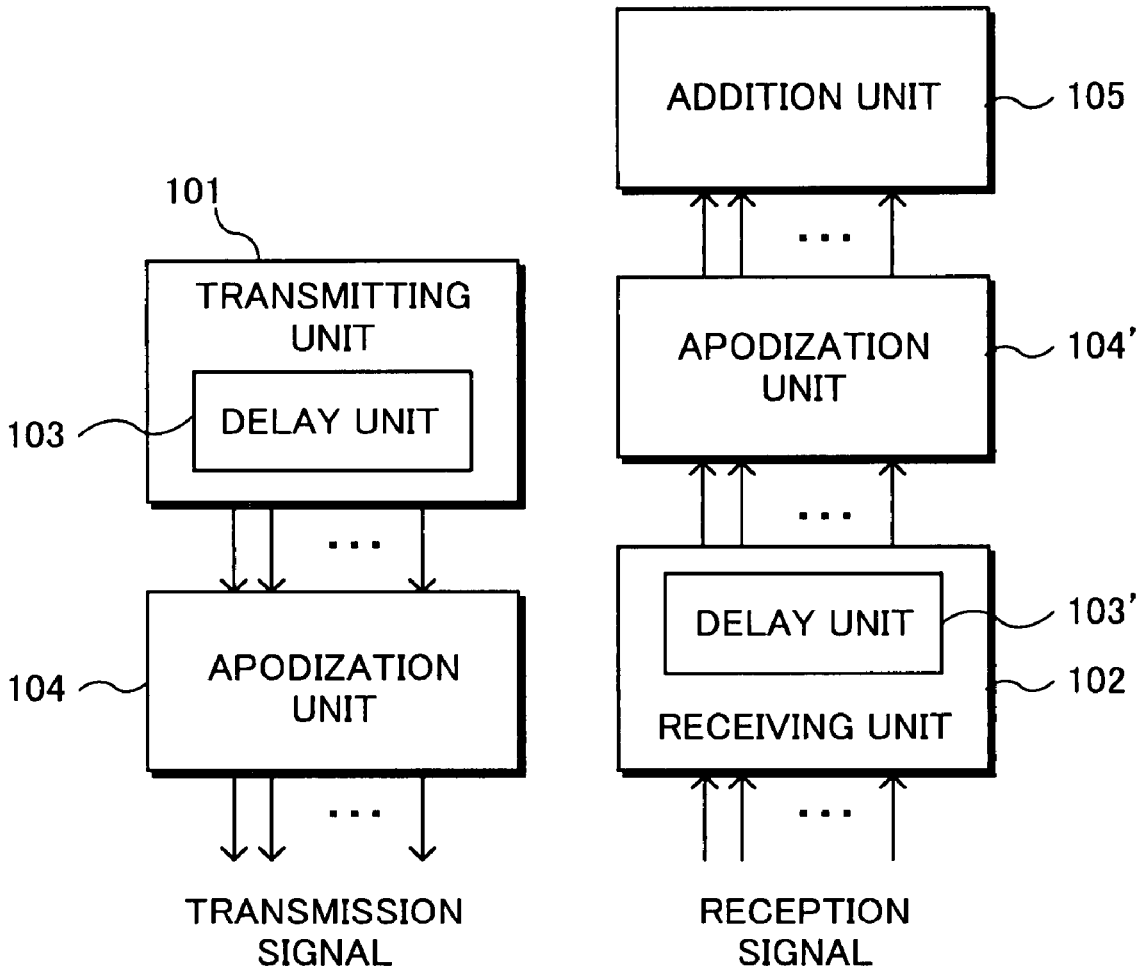
FIG.4 PRIOR ART
FIG. 4 shows a schematic representation of components of the conventional beamforming apparatus.
Figure 5A:
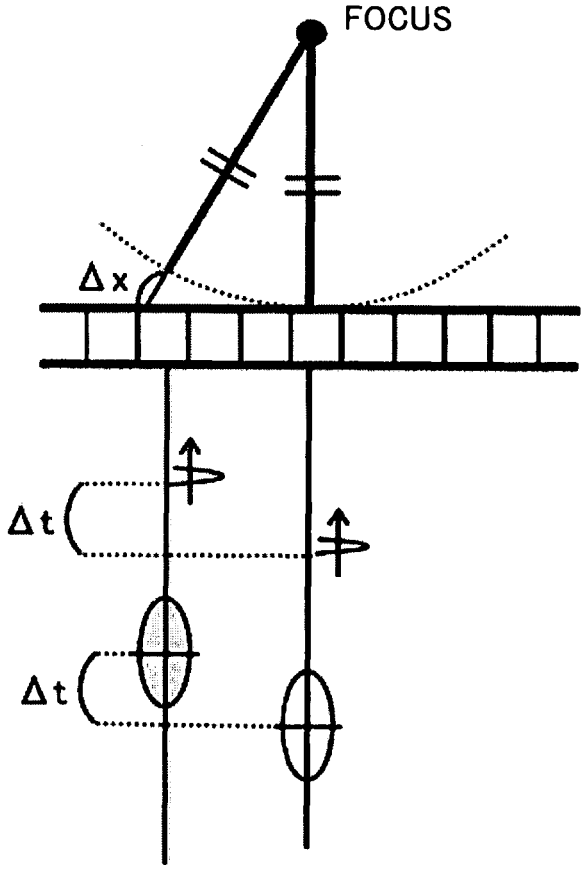
FIG.5A PRIOR ART
FIGS. 5A and 5B show the examples of beamforming, i.e., focusing and steering, respectively.
Figure 5B:
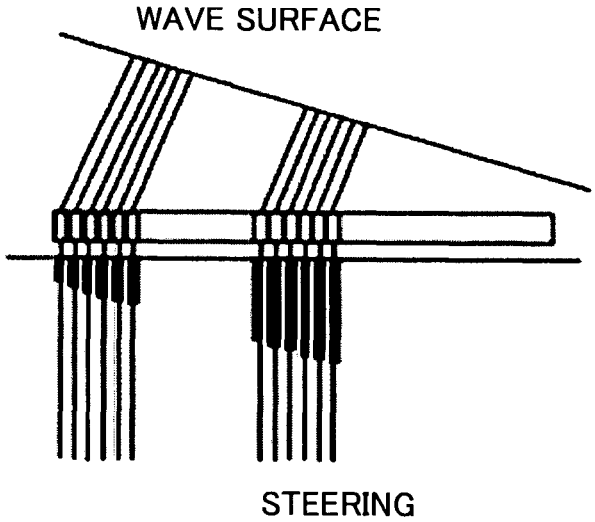
FIG.5B PRIOR ART

Next, a second embodiment of the present invention will be explained. FIG. 3 shows a schematic representation of components of the beamforming apparatus according to the second embodiments of the present invention. The beamforming apparatus includes a transmitting unit 1, a receiving unit 2, apodizing units 4 and 4', an addition unit 5, and a signal processing unit 10. The units 1 and 2 are respectively equipped with delay units 3 and 3'.

For instance, this beamforming apparatus can be applied to an ultrasonic diagnosis apparatus. Occasionally, the mechanical shift in lateral and/or elevational directions of the elements (array transducers) is also performed, if necessarily. The parameters for the transmission and reception beamforming can be determined individually. Otherwise, either result can also be used for both the transmission and reception beamforming.

The beamforming apparatus uses at least one of the beamforming parameters such as the intensities, frequencies, bandwidths and shapes of the signals transmitted by the transmitting unit 1, the filtering of noises, amplifications (gains) and shapes of the signals received by the receiving unit 2, the number of the additions of the signals by the addition unit 5, apodization functions to be used by the apodization units 4 and 4' according to the directions of propagation and the array, delays to be used by the delay units 3 and 3' according to the directions of propagation and the array, which are calculated by another apparatus including the input unit 6' for inputting the PSF and the calculation unit 7'. The other apparatus may also include the data output unit 8'. Thus, the beamforming apparatus includes a data input unit 11 for inputting the calculated parameters. The calculation unit 7' can be connected to a display unit 9' that shows the actually realized PSF. The respective parameters may be optimized under related some constraints, e.g., an effective aperture size, an available energy or intensity and so on.

The present invention can be used to realize the beamforming that optimally realize the desired PSF, e.g., the improvement of all the spatial resolution and contrast of the measurement target (e.g., image), the spatial resolution and effectiveness of the treatment, measurement accuracy of target motion (including the spatial resolution) when using array elements of radars, sonars and ultrasonic diagnosis apparatuses, etc.

The invention claimed is:

1. A beamforming apparatus comprising:

a transmitting unit for generating transmission signals, adding respective delays to the transmission signals for transmission beamforming, and supplying the transmission signals to a transducer array including plural elements;

a first apodization unit for adjusting at least one of amplitudes and waveforms of the transmission signals;

a receiving unit for receiving reception signals from said transducer array, amplifying and filtering the reception signals, and adding respective delays to the reception signals;

a second apodization unit for adjusting at least one of amplitudes and waveforms of the reception signals;

an addition unit for adding the reception signals to one another for reception beamforming; and a calculation unit for calculating a point spread function representing spread of a beam at a selected point so as to obtain at least one of array parameters and beamforming parameters to be used in at least one of said transducer array, said transmitting unit, said receiving unit, said first and second apodization units, and said addition unit by minimizing a squared error between the calculated point spread function and a predetermined point spread function by using at least one of (i) an optimization method selected from a combination of a linear method and a regularization method and a combination of a nonlinear method and a regularization method, (ii) a linear programming method, and (iii) a dynamic programming method.

2. A beamforming apparatus according to claim 1, wherein:

said array parameters include an element size, an element shape, connections between the plural elements and surrounding units, and a number of the plural elements to be used; and said beamforming parameters include intensities, delays, frequencies, bandwidths and shapes of the transmission signals, and intensities, delays, frequencies, bandwidths, shapes, and apodizations of the reception signals, and a number of the reception signals to be used.

3. A beamforming method comprising:

(a) generating transmission signals, adding respective delays to the transmission signals for transmission beamforming, and supplying the transmission signals to a transducer array including plural elements;

(b) adjusting at least one of amplitudes and waveforms of the transmission signals;

(c) receiving reception signals from said transducer array, amplifying and filtering the reception signals, and adding respective delays to the reception signals;

(d) adjusting at least one of amplitudes and waveforms of the reception signals;

(e) adding the reception signals to one another for reception beamforming; and (f) previously calculating a point spread function representing spread of a beam at a selected point so as to obtain at least one of array parameters and beamforming parameters to be used at at least one of step (a) to (e) by minimizing a squared error between the calculated point spread function and a predetermined point spread function by using at least one of (i) an optimization method selected from a combination of a linear method and a regularization method and a combination of a nonlinear method and a regularization method, (ii) a linear programming method, and (iii) a dynamic programming method.

4. A beamforming method according to claim 3, wherein:

said array parameters include an element size, an element shape, connections between the plural elements and surrounding units, and a number of the plural elements to be used; and said beamforming parameters include intensities, delays, frequencies, bandwidths and shapes of the transmission signals, and intensities, delays, frequencies, bandwidths, shapes, and apodizations of the reception signals, and a number of the reception signals to be used.

* * * * *